US006131318A

United States Patent [19]

Hsieh

[11] Patent Number: 6,131,318

[45] Date of Patent: Oct. 17, 2000

[54] AQUARIUM-USED TOY STRUCTURE

[76] Inventor: Chien-Chih Hsieh, 7F, No. 218, Sec. 3, Ta-Tung Rd., Hsi-Chih Town, Taipei Hsien, Taiwan

[21] Appl. No.: 09/253,938

[22] Filed: Feb. 22, 1999

[51] Int. Cl.[7] ..... G09F 19/00

[52] U.S. Cl. ..... 40/406; 40/426; 446/134

[58] Field of Search ..... 40/406, 409, 426; 446/133, 134, 136, 129, 267

[56] References Cited

U.S. PATENT DOCUMENTS 3,239,956 3/1966 Canonica, Jr. ..... 40/426 X
5,301,444 4/1994 Horiuchi ..... 40/426
5,463,826 11/1995 Horiuchi ..... 40/426
5,603,994 2/1997 Su ..... 40/426 X

*Primary Examiner*—Terry Lee Melius
*Assistant Examiner*—James M. Hewitt
*Attorney, Agent, or Firm*—Varndell & Varndell, PLLC

[57] ABSTRACT

An aquarium toy structure includes a back body and a front body with an observation window. A transparent water tank is inserted in the observation window and toy fish having magnets are placed in the water tank. A motor and a rotary shaft having magnets are disposed in the back body. The motor rotates the rotary shaft through belts, so that the toy fish are magnetically attracted and repelled by the magnets of the rotary shaft to freely swing back and forth in the water to mimic the swimming of real fish.

2 Claims, 4 Drawing Sheets

AQUARIUM-USED TOY STRUCTURE

BACKGROUND OF THE INVENTION

The present invention relates to an aquarium-used toy structure in which toy fishes freely swing back and forth in the water like real fishes.

The conventional aquarium-used toy fishes can move back and forth in the water like real fishes by means of magnetically attractive or repelling force.

In order to create live swinging action of the toy fishes, multiple magnets hidden in the toy fishes and a driving means are necessary for producing a magnetic field. Such structure is complicated and the possibility of malfunction is relatively high.

The conventional bottle-shaped aquarium-used toy includes an opaque bottle-shaped container main body. The front side of the trunk of the main body is formed with a transparent water tank. The back side of the water tank is disposed with a rotary shaft and driving magnet for producing magnetic field. The water tank is filled with a liquid and toy fishes which have magnets therein. The toy fishes, are magnetically attracted or repelled to move back and forth in the water tank like real fishes so as to create a funny entertaining effect. However, in such structure, the action of the toy fishes is still monotonous and many cooperative gears are required.

SUMMARY OF THE INVENTION

It is a primary object of the present invention to provide an aquarium-used toy structure in which toy fishes can more lively swing back and forth in the water like real fishes.

It is a further object of the present invention to provide the above aquarium-used toy structure which is simplified.

According to the above objects, the aquarium-used toy structure of the present invention includes a rectangular back body, a transparent water tank arranged between the front and back bodies. The front body has a convex top and bottom separated by an observation window. The transparent water tank is inserted in the observation window and toy fish with magnets are placed in the transparent water tank. A motor and a magnetic rotary shaft having magnet are arranged in the rectangular back body. The motor operates to rotate the rotary shaft, whereby the toy fish are magnetically attracted and repelled by the magnets of the rotary shaft to freely swing back and forth in the water like real fishes.

The present invention can be best understood through the following description and accompanying drawings, wherein:

DETAILED DESCRIPTION OF THE PREFERRED EMBODIMENT

Figure 2:
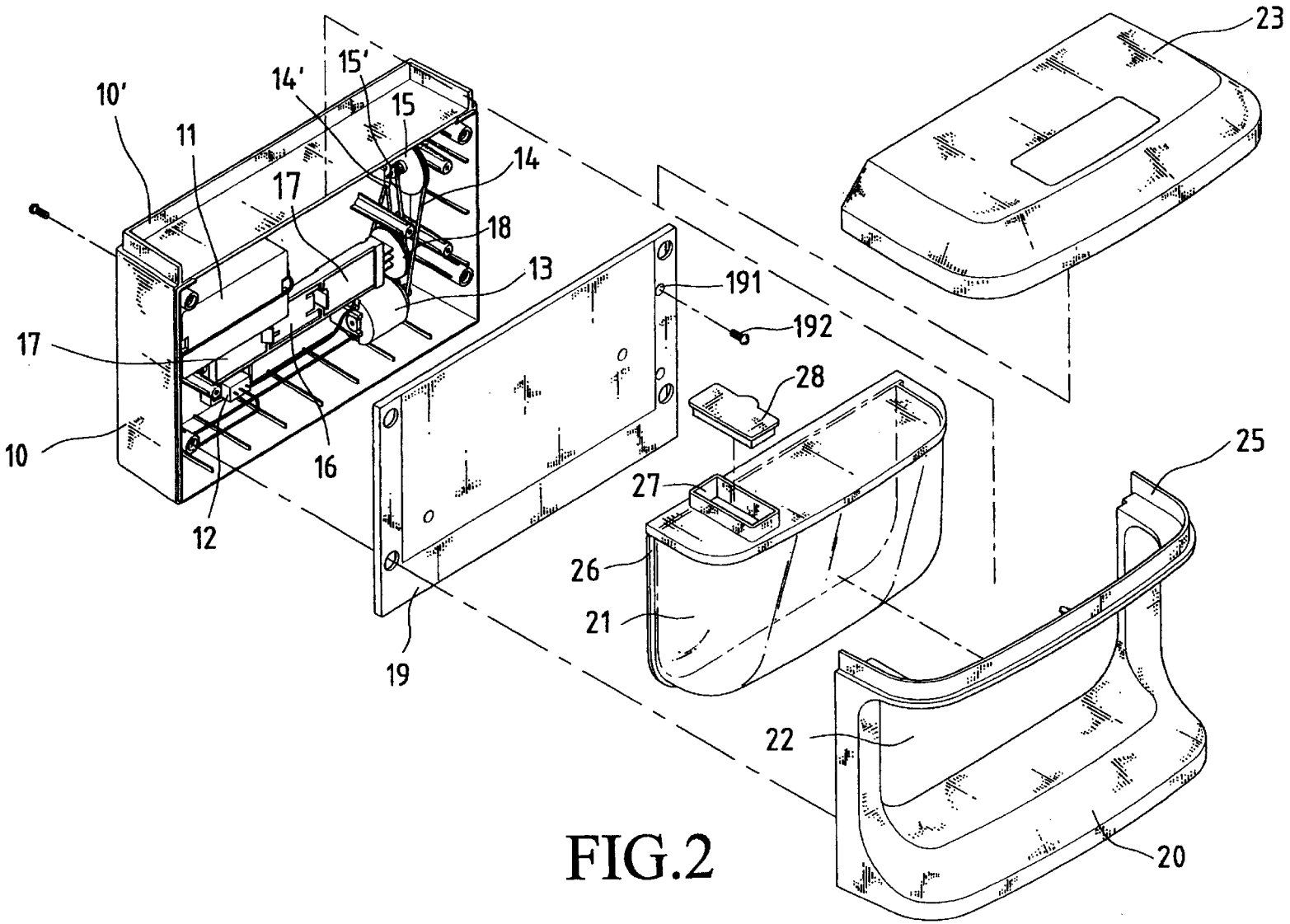
FIG. 2 is a perspective exploded view of the present invention.

Please refer to FIG. 2. The present invention includes a back body 10, a transparent water tank 21, a front body 20, and toy fish 24. The back body 10 has rectangular shape. The periphery of the top end of the back body is formed with insertion rim 10'. The rear of the back body contains a cell chamber 11, and a lower edge of the back body 10 has a power switch 12. The bottom of the interior of the back body 10 houses a motor 13. A rotary disk is arranged above the motor 13 in the back body 10. The rotary disk has a large wheel 15 and a small wheel 15'. One end of a rubber ring 14 is fitted around a rotary shaft of the motor 13, and the other end of the rubber ring 14 is arranged on the large wheel 15. A shorter rubber ring 14' has one end fitted on the small wheel 15' and the other end fitted in a recess 18 arranged on the periphery of a wheel mounted on one end of the rotary shaft 16. Two magnets 17 are respectively provided near the two ends of the rotary shaft 16. Screws 192 are screwed into thread holes 191 of the corners of a partitioning plate 19 to secure the front body 20 to the back body 10. A picture of an underwater scene or view can be attached to or printed on the partitioning plate 19 to create a live visual effect.

The front end of the partitioning plate 19 is arranged behind the front body 20. The front body 20 has a rectangular back, a convex top and bottom, and an window opening 22 provided between the convex and bottom. The top end of the front body 20 is formed with an insertion rim 25.

Figure 1:
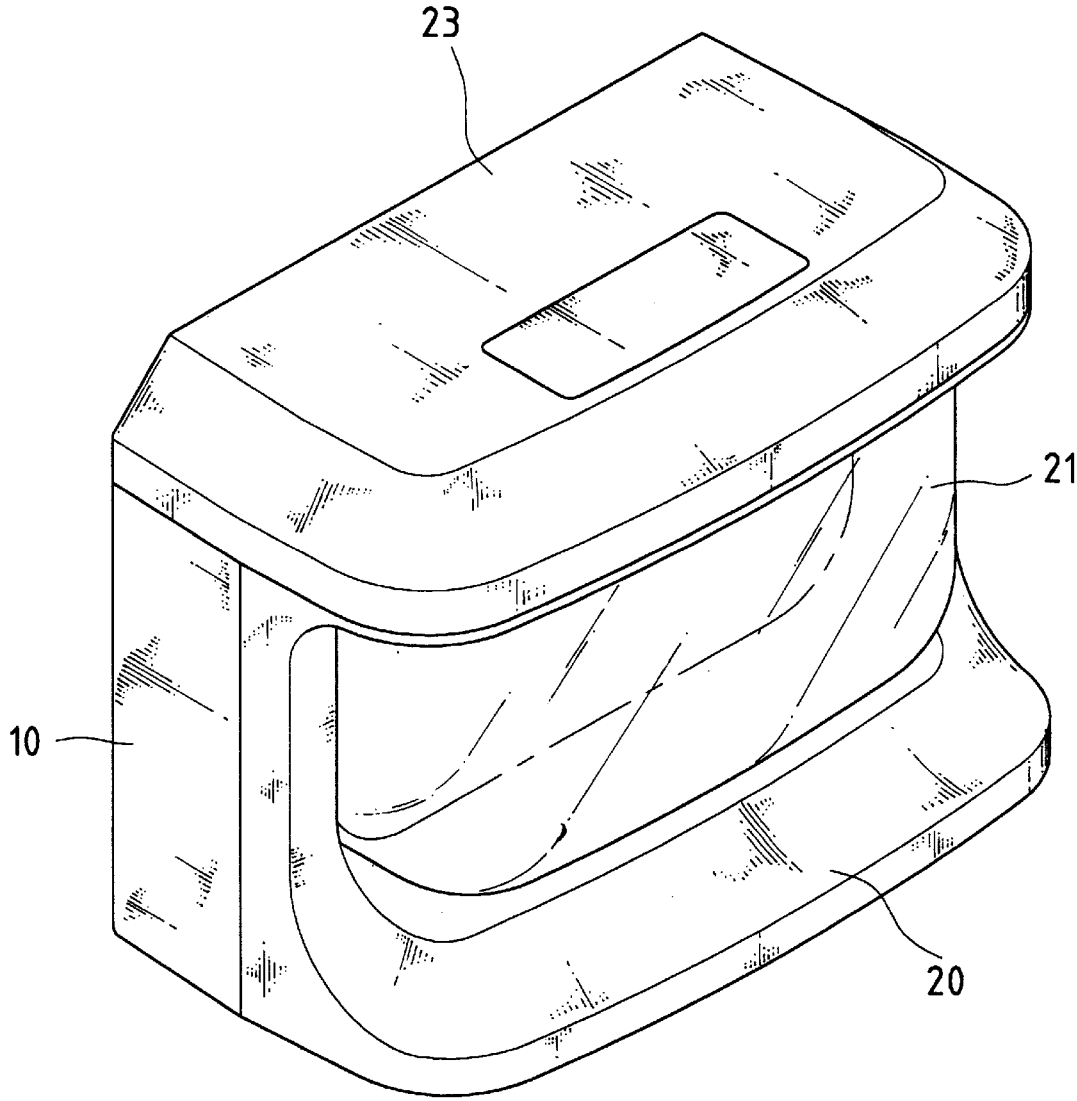
FIG. 1 is a perspective assembled view of the present invention.

The transparent water tank 21 is provided in the window opening 22 of the front body 20. The transparent water tank 21 has a shape matching that of the window opening 22. The transparent water tank has a back wall 26, a convex side wall, and a bottom. The convex side wall has an arched projecting panel inserted into the window opening 22 of the front body 20 and is adapted to provide a wide angle of view. The top wall of the water tank 21 is provided with a water opening 27 that can be covered by a plug 28. A top cover 23 is provided to cover back body 10, the partitioning plate 19, the transparent water tank 21, and the front body 20. The top cover 23 has a thickness and profile matching that of the combined back body 10, the partitioning plate 19, the transparent water tank 21, and the front body 20. The edge of the top cover 23 receives the insertion rims 25, 10' of the front body 20 and the back body 10 to complete the assembly of the present invention (as shown in FIG. 1).

Figure 3:
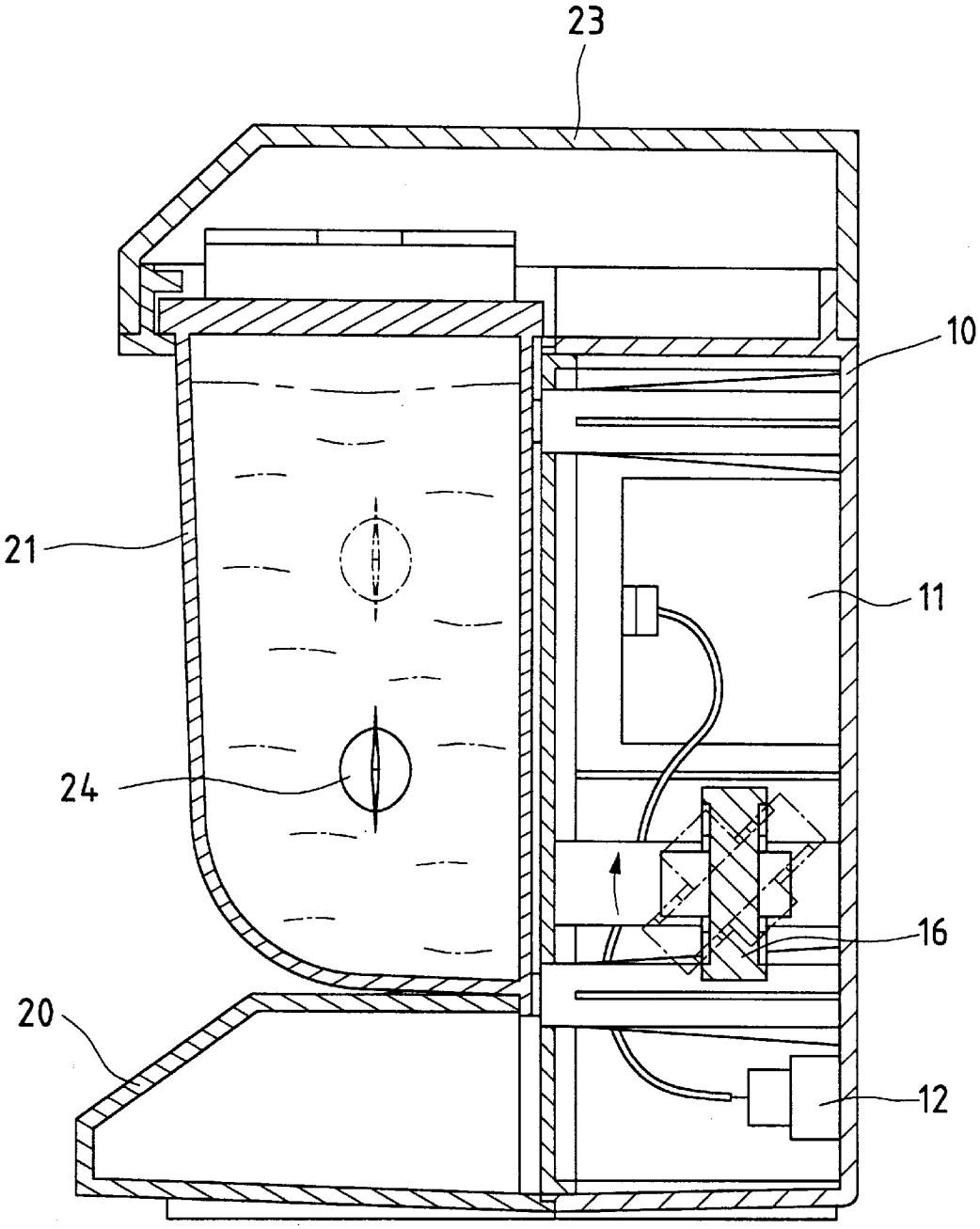
FIG. 3 is a sectional view showing the operation of the present invention.
Figure 4:
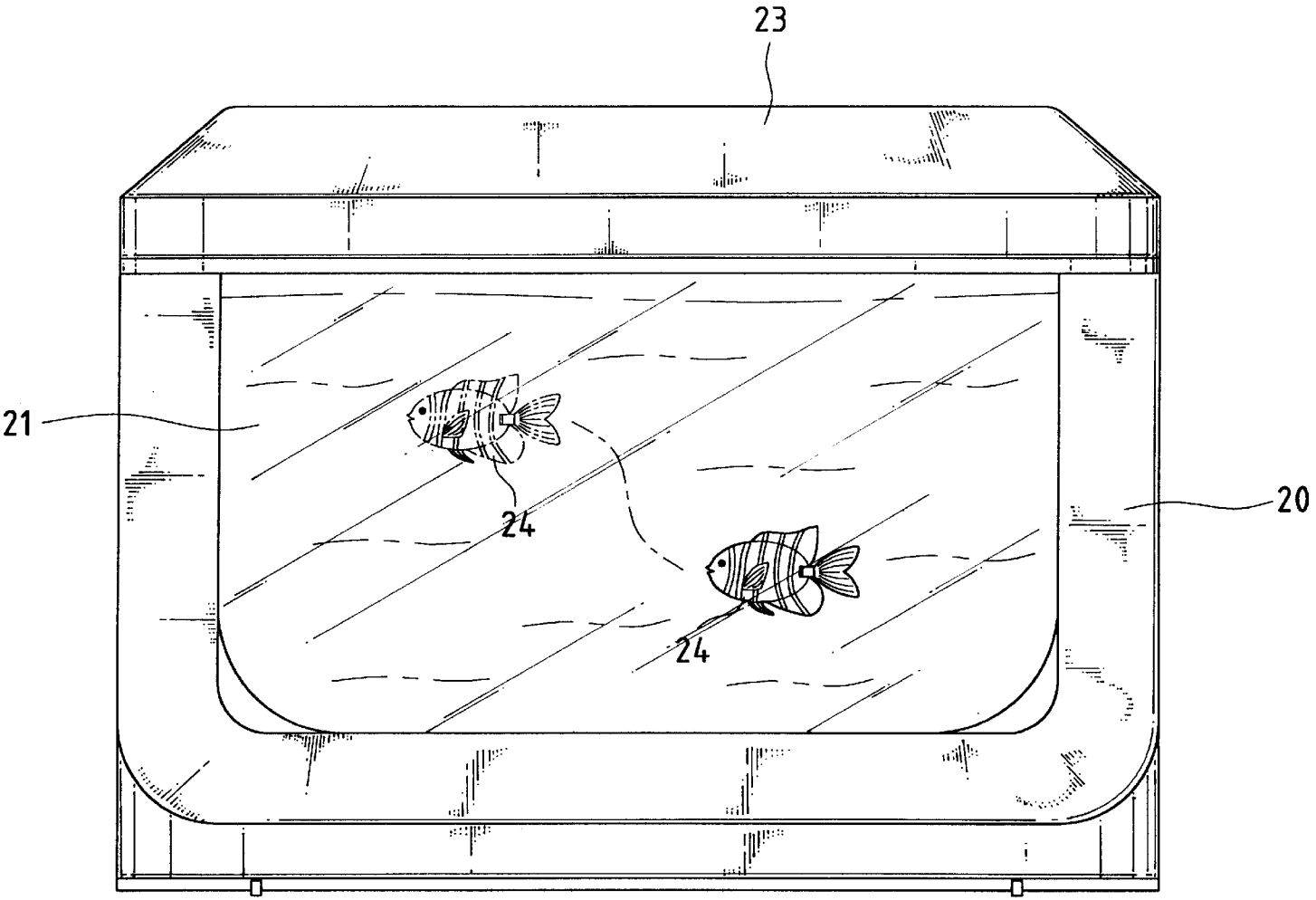
FIG. 4 shows that the toy fishes swing in the water tank of the present invention.

Please refer to FIGS. 3 and 4. The transparent water tank 21 is filled with water and the toy fish 24. The toy fish are equipped with magnets. The specific gravity of the toy fish is equal to that of the water. Therefore, after the power switch 12 is switched on and the motor 13 is rotated to drive the large wheel 15 via the rubber ring 14, the large wheel 15 drives the other rubber ring 14' in recess 18 to rotate the wheel on the one end of the rotary shaft 16 and thereby rotate the rotary shaft 16. This arrangement provides a reducing mechanism that slows the rotation of rotary shaft 16. Therefore, the magnets 17 arranged near or at the two ends of the rotary shaft 16 are rotated. The magnets 17 arranged near or at the two ends of the rotary shaft and those in the toy fish, as all magnets, have a north and a south pole at different parts thereof. The magnets in the toy fish 24 are magnetically attracted and repelled by the magnets 17 of the rotary shaft 16. For example, the toy fish are attracted to the magnets 17 of the rotary shaft 16 when different poles (i.e., north and south poles) are adjacent each other, and the toy fish are repelled by the magnets 17 of the rotary shaft 16 when identical poles (i.e., north and north poles) are adjacent each other. When the rotary shaft 16 rotates, the poles of the magnets 17 are rotated changing the magnetic fields thereabout, resulting in the toy fish 24 to move toward and away from the magnets 17 of the rotary shaft 16. This action of the toy fish 24 mimics the swimming of real fish and creates the sensation of live fish swimming in the aquarium.

It should be noted that the above description and accompanying drawings are only used to illustrate one embodiment of the present invention, not intended to limit the scope thereof. Any modification of the embodiment should fall within the scope of the present invention.

What is claimed is:

1. An aquarium toy structure comprising:

a front body having a rectangular back, a convex top, a convex bottom and a middle with an opening; the convex top having a having an upper edge forming an insertion rim, and the convex bottom having upper wall forming a shelf for the opening;

a transparent water tank held in the opening of the front body; the transparent water tank having a flat back wall, a convex side wall, a bottom wall, a top wall having a water opening, and a plug received in the water opening; the convex side wall of the transparent water tank shaped to provide a wide angle of view for contents contained therein;

a partitioning plate having corners with holes and a picture, the partitioning plate being arranged behind the flat back wall of the transparent water tank so that the picture is seen through the convex side wall of the transparent water tank;

a back body having a rectangular shape matching that of the rectangular back of the front body, corners with thread hole posts, a top with an insertion rim, a cell chamber to hold a battery, and a motor electrically connected to the cell chamber through a switch; the motor having a drive shaft driving a rotary disc by a first rubber ring rotating around the drive shaft, the rotary disc having a large wheel working with the first rubber ring to rotate the rotary disc and a small wheel, the small wheel of the rotary disc driving a rotary shaft by a second rubber ring rotating around the small wheel of the rotary disc and the rotary shaft, the rotary shaft having at least two magnets coaxially arranged along a length of the rotary shaft;

a top cover having a thickness matching a total thickness of the back body, the partitioning plate, the water tank and the front body; a bottom edge of the top cover receiving the insertion rims of the front body and the back body; and toy fish and water contained in the transparent water tank, the toy fish having magnets and a specific gravity equal to that of the water, wherein when the rotary shaft rotates, the toy fish are magnetically attracted and repelled by the magnets of the rotary shaft to freely move back and forth in the water to mimic swimming of real fish.

2. The aquarium toy structure according to claim 1, wherein the bottom wall of the transparent water tank is arranged adjacent the shelf of the opening of the front body, and the back wall of the transparent water tank has a width and length greater than those of the opening of the front body forming a ledge for holding the transparent water tank in the opening of the front body.

* * * * *